US005664509A

United States Patent [19]

Tseng

[11] Patent Number: 5,664,509

[45] Date of Patent: Sep. 9, 1997

[54] LOOPER DRIVING ASSEMBLY FOR A SEWING MACHINE

[76] Inventor: Hsien-Chang Tseng, 9F., No. 13-4, Sec. 1, Da Ching Street, Taichung, Taiwan

[21] Appl. No.: 716,898

[22] Filed: Sep. 20, 1996

[51] Int. Cl.[6] ..... D05B 57/34

[52] U.S. Cl. ..... 112/200; 112/162

[58] Field of Search ..... 112/162, 199, 112/200, 172, 177, 220, 284, 475.26

[56] References Cited

U.S. PATENT DOCUMENTS

| | | | |
|---|---|---|---|
| 971,229 | 9/1910 | Weis | 112/162 |
| 3,881,434 | 5/1975 | Kelly | 112/162 |
| 4,543,896 | 10/1985 | Desantis | 112/162 |
| 4,690,080 | 9/1987 | Mikuni et al. | 112/162 |
| 5,237,942 | 8/1993 | Satoma | 112/162 |
| 5,255,622 | 10/1993 | Baba et al. | 112/162 |

*Primary Examiner*—Ismael Izaguirre
*Attorney, Agent, or Firm*—Charles E. Baxley, Esq.

[57] ABSTRACT

A driving assembly includes a shaft pivotally supported in a sewing machine. A rod is movable up and down and includes a looper secured on top. A follower is secured to the shaft and includes a post. A block is slidably engaged on the post and includes a pivot axle pivotally coupled to the rod for moving the rod up and down. The block is adjusted along the rod for adjusting the distance between the pivot axle and the shaft and for adjusting a moving stroke of the looper. The rod and the looper are stopped when the pivot axle is moved to coincide with the shaft.

5 Claims, 4 Drawing Sheets

LOOPER DRIVING ASSEMBLY FOR A SEWING MACHINE

BACKGROUND OF THE INVENTION

1. Field of the Invention

The present invention relates to a driving assembly, and more particularly to a driving assembly for controlling the moving stroke of a looper of an overlock sewing machine.

2. Description of the Prior Art

A typical looper driving assembly for a sewing machine is disclosed in U.S. Pat. No. 4,690,080 to Mikuni et al. and comprises a locking pin for engaging with a hole of a connecting member of a swing member and for controlling the movement of the lower looper. When the locking pin is engaged with the connecting member, the lower looper may be moved up and down for conducting stitching operation. When the locking pin is disengaged from the connecting member, the lower looper may not be operated and may not conduct stitching operation. However, the moving stroke of the looper may not be adjusted. In addition, when the locking pin is disengaged from the connecting member, the lower looper is released and may be caused to move upward and downward inadvertently when any frictional force is applied to the lower looper and the connecting member. This is dangerous and may disorder the operations of the other needles and loopers which may have a good chance to be broken.

The present invention has arisen to mitigate and/or obviate the afore-described disadvantages of the conventional overlock sewing machine.

SUMMARY OF THE INVENTION

The primary objective of the present invention is to provide a driving assembly for adjusting the moving stroke of the looper member of the sewing machine.

The other objective of the present invention is to provide a driving assembly for stopping the movement of the looper member of the sewing machine.

In accordance with one aspect of the invention, there is provided a looper driving assembly for a sewing machine, the looper driving assembly comprises a shaft for pivotally supporting in the sewing machine and for rotating in a reciprocating action, a support for rotatably securing to the sewing machine, the support including an orifice formed therein, a rod slidably engaging in the orifice of the support for moving up and down along the orifice, the rod including an upper portion having a looper secured thereon and including a lower portion, a follower secured to the shaft and rotated in concert with the shaft, the follower including a guiding member provided therein and including a pivot axle slidably received in the guiding member for being adjusted along the guiding member and for adjusting a distance between the pivot axle and the shaft, and means for coupling the pivot axle to the lower portion of the rod for moving the rod up and down when the pivot axle and the follower are rotated by the shaft. The pivot axle is moved along the guiding member for adjusting the distance between the pivot axle and the shaft and for adjusting a moving stroke of the rod and the looper.

The coupling means includes a lever for pivotally coupling to the sewing machine at a pivot pin, the lever includes an extension pivotally coupled to the lower portion of the rod for moving the rod and the looper up and down when the lever is rotated about the pivot pin.

The coupling means further includes a link having a first end pivotally coupled to the pivot axle and having a second end pivotally coupled to the lever for rotating the lever when the follower is rotated by the shaft.

The guiding member includes a post, and a block slidably engaged on the post for sliding up and down along the post, the pivot axle is provided in the block.

The post includes a bottom portion for aligning with the shaft and for allowing the pivot axle to be moved to coincide with the shaft and for stopping the rod and the looper.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
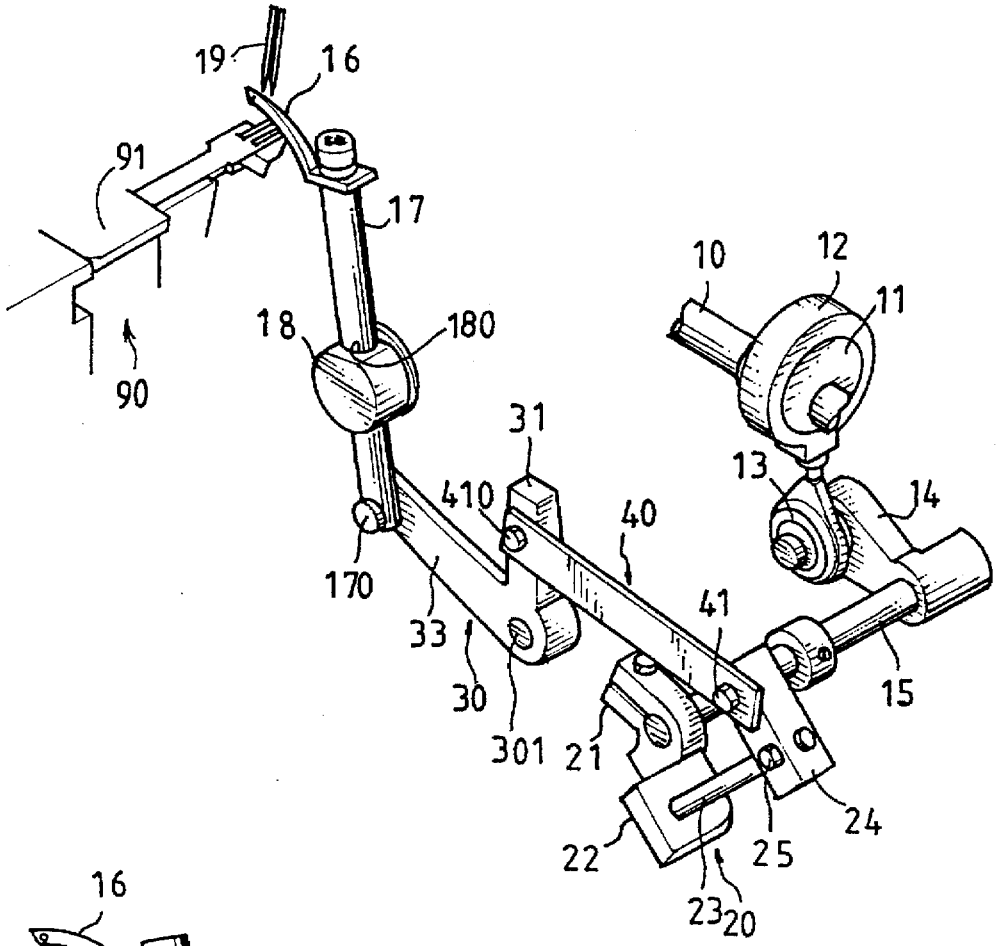
FIG. 1 is a perspective view of a looper driving assembly in accordance with the present invention.
Figure 2:
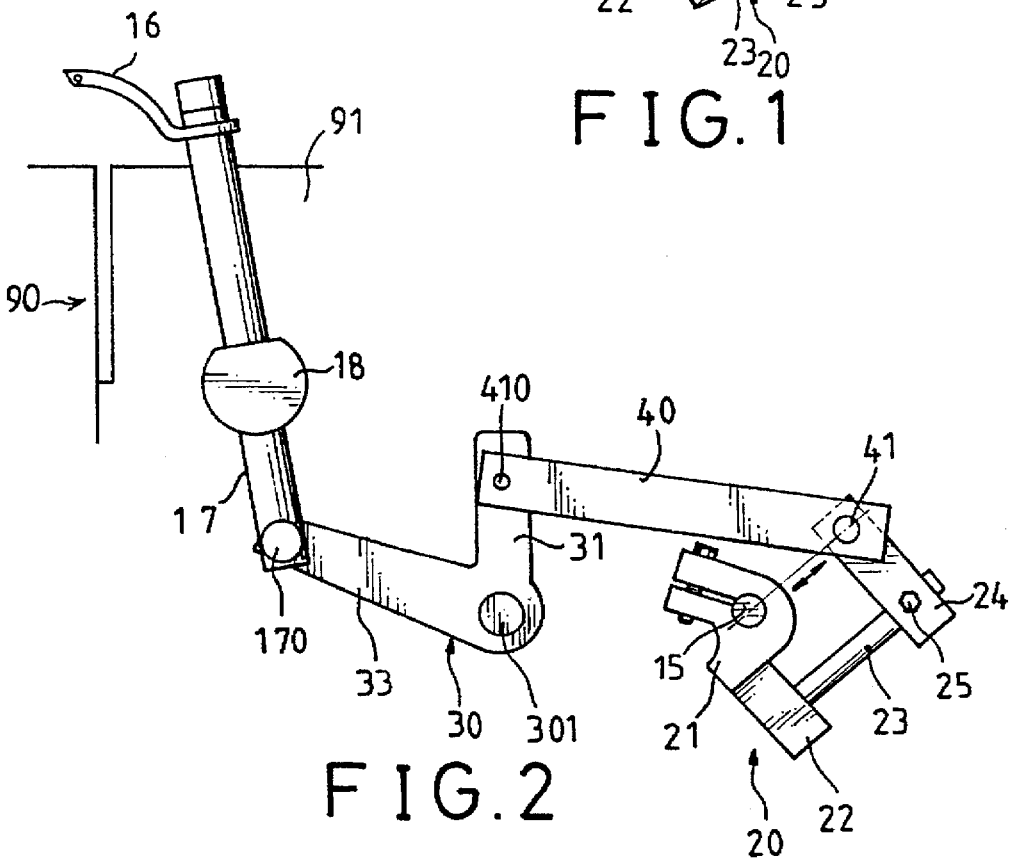
FIGS. 2, 3, 4 are plane views illustrating the operation of the looper driving assembly.
Figure 3:
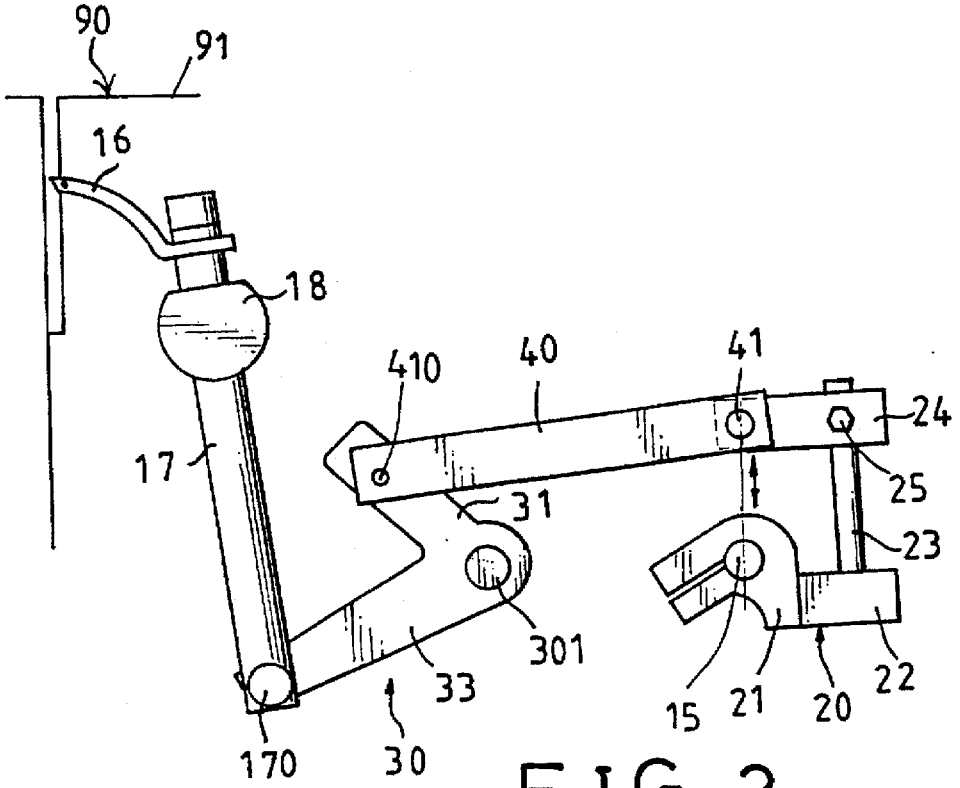

Referring to the drawings, and initially to FIGS. 1 to 3, a looper driving assembly in accordance with the present invention comprises a driving spindle 10 which is typically operated and rotated by a motor of a sewing machine. A cam 11 is secured on the driving spindle 10 and rotated in concert with the driving spindle 10. A sleeve 12 is rotatably engaged on the cam 11 so as to be moved up and down by the cam 11. A universal joint 13 is secured to the sleeve 12 and secured to one end of an arm 14 which has the other end secured to a shaft 15, such that the shaft 15 may be rotated in a reciprocating action by the driving spindle 10. The coupling of the driving spindle 10 to the shaft 15 is conventional and will not be described in further details.

A support 18 is rotatably secured to the sewing machine 90 and includes an orifice 180 for slidably engaging with a rod 17 which includes a looper 16 secured to the upper end for co-acting with the needle 19 so as to conduct stitching operation. The rod 17 is slidable along the orifice 180 for moving up (FIG. 2) or down (FIG. 3) relative to a working table 91 of an overlock sewing machine. A lever 30 includes a middle portion pivotally coupled to the sewing machine 90 at a pivot pin 301 and includes an extension 33 pivotally coupled to the lower end of the rod 17 at a pivot axis 170 such that the rod 17 and the looper 16 may be moved up and down by the lever 30 when the lever 30 is rotated about the pivot pin 301. The lever 30 includes a projection 31 extended therefrom.

A follower 20 includes a pair of flanges 21 for securing to the shaft 15 by fastening screws and includes a base 22 having a guiding member, such as a post 23 extended therefrom. A block 24 is slidably engaged on the post 23 and slidable up and down along the post 23. The block 24 may be secured to the post 23 by fastening screw 25. It is to be noted that the base 22 and the post 23 and the block 24 may be considered as a solid body which is rotated and driven by the shaft 15. A link 40 includes one end pivotally coupled to the block 24 at a pivot axle 41 and includes the other end pivotally coupled to the projection 31 of the lever 30 at a pivot pin 410 for rotating the lever 30 when the base 22 and the block 24 are rotated by the shaft 15. The post 23 includes a bottom portion aligned with the shaft 15 for allowing the pivot axle 41 to be moved to coincide with the shaft 15.

Figure 5:
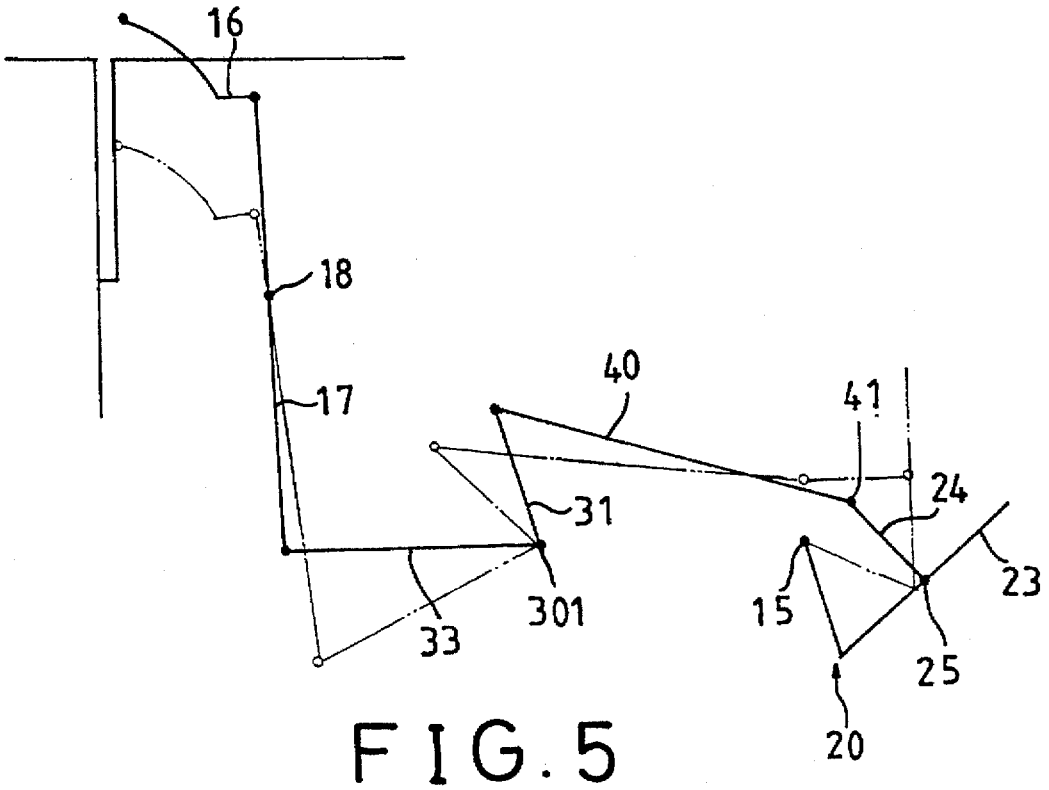
FIGS. 5 and 6 are schematic views illustrating the operation of the looper driving assembly.

Referring next to FIG. 5, when the block 24 is adjusted along the post 23, for example, when the block 24 is adjusted to the middle portion of the post 23, the upward and downward moving stroke of the looper 16 may be adjusted to a smaller moving stroke.

Figure 4:
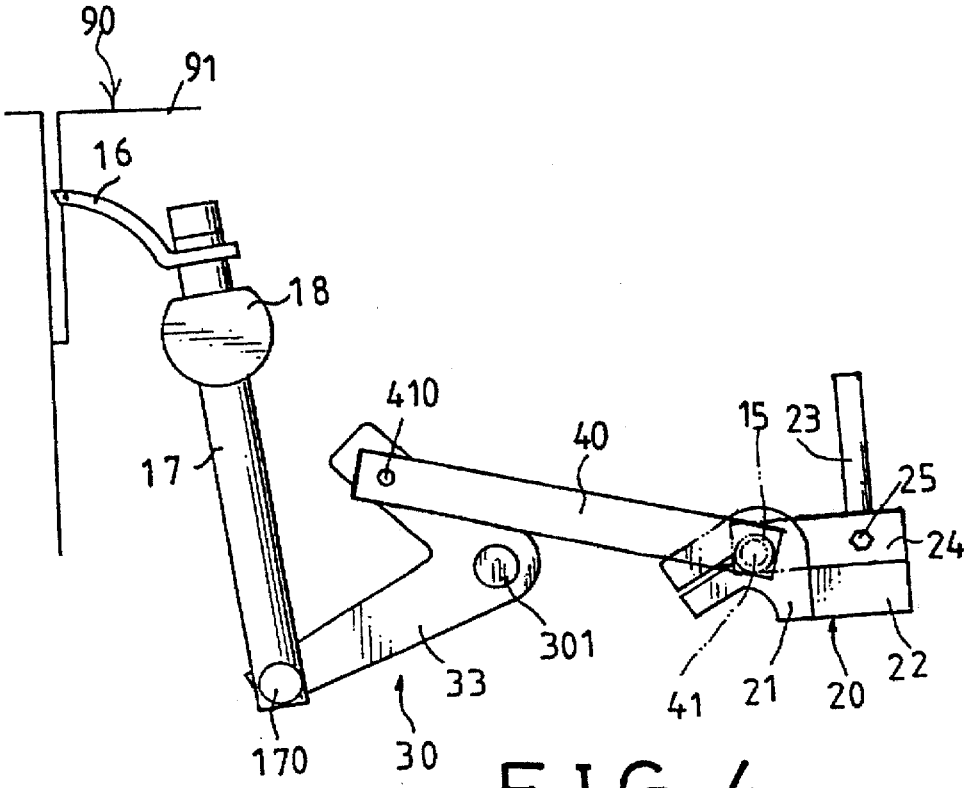
Figure 6:
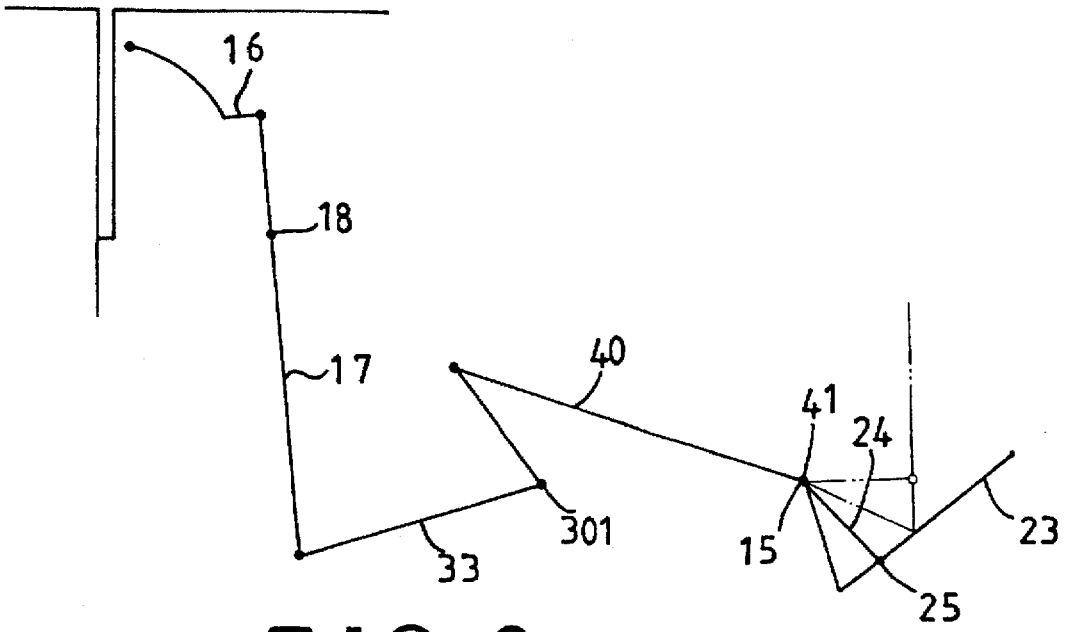

Referring next to FIGS. 4 and 6, when the block 24 is moved to the bottom of the post 23, the pivot axle 41 of the block 24 may coincide with the shaft 15. At this moment, the link 40 will not be moved when the follower 20 and the block 24 are rotated by the shaft 15. The looper 16 is thus stopped and may not be operated. It is to be noted that the looper 16 and the rod 17 and the lever 30 and the link 40 are stably retained in place and will not be inadvertently operated such that the looper 16 may thus be stably held in place when it is not required to be operated.

Figure 7:
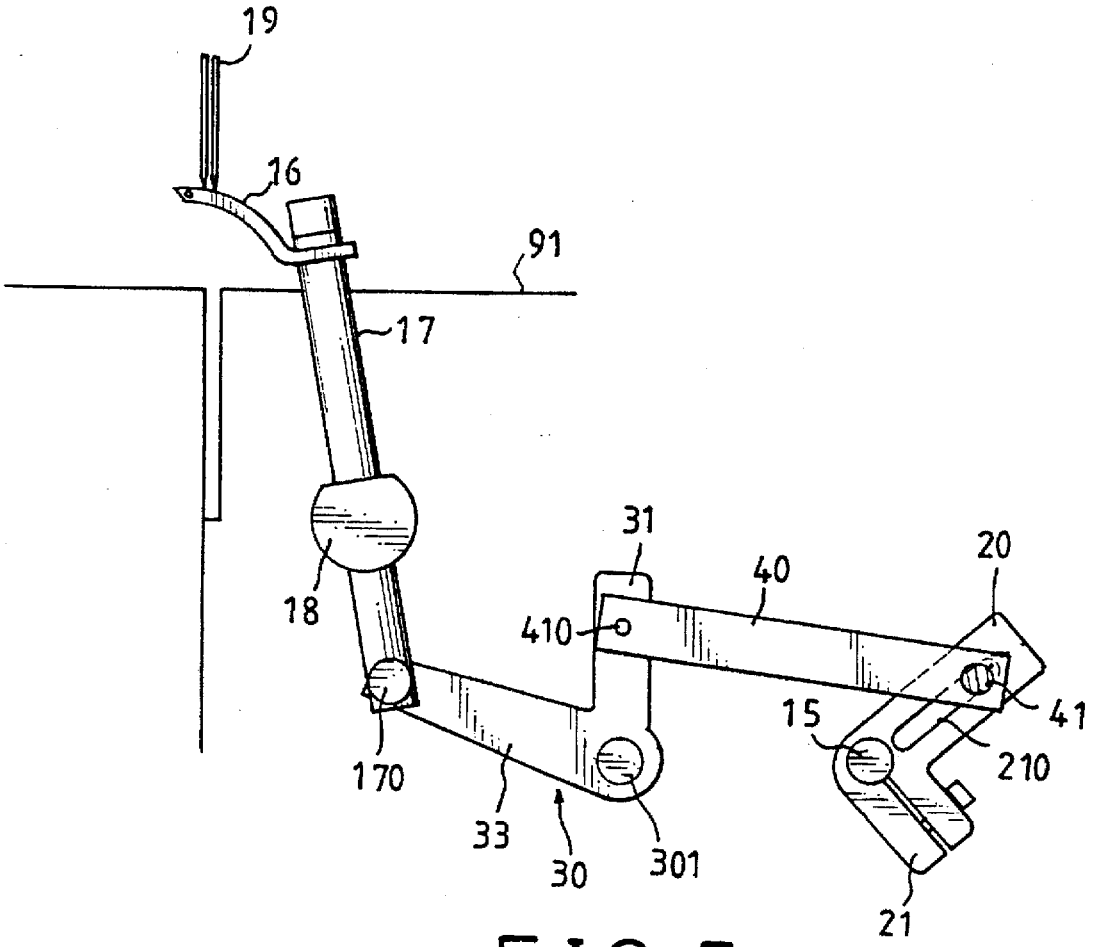
FIG. 7 is a plane view illustrating another application of the looper driving assembly.
Figure 8:
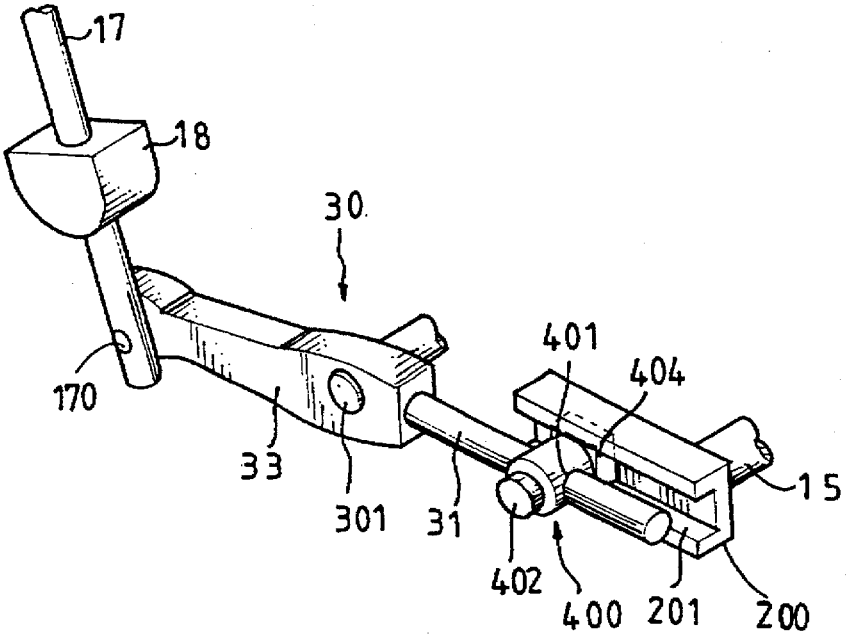
FIG. 8 is a partial perspective view illustrating a further application of the looper driving assembly.

Referring next to FIG. 7, the follower 20 may include a channel 210 formed therein for slidably receiving the pivot axle 41, such that the pivot axle 41 may also be adjusted along the channel 210 for adjusting the moving stroke of the looper 16. As shown in FIG. 8, the follower 200 may be secured to the shaft 15 and includes a channel 201 formed therein for slidably receiving a block 404 which is secured to a connector 400. The connector 400 includes an aperture 401 for slidably engaging on the projection 31 of the lever 30 and for securing to the projection 31 by fastening screw 402. The movement of the block 404 along the channel 201 may adjust the relative distance between the connector 400 and the shaft 15 and may thus adjust the moving stroke of the rod 17.

Accordingly, the looper driving assembly in accordance with the present invention may be provided for adjusting the moving stroke of the looper member of the sewing machine and may be provided for stopping the movement of the looper member of the sewing machine, when required.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A looper driving assembly for a sewing machine, said looper driving assembly comprising:

a shaft for pivotally supporting in the sewing machine and for rotating in a reciprocating action, a support for rotatably securing to the sewing machine, said support including an orifice formed therein, a rod slidably engaging in said orifice of said support for moving up and down along said orifice, said rod including an upper portion having a looper secured thereon and including a lower portion, a follower secured to said shaft and rotated in concert with said shaft, said follower including a guiding member provided therein and including a pivot axle slidably received in said guiding member for being adjusted along said guiding member and for adjusting a distance between said pivot axle and said shaft, and means for coupling said pivot axle to said lower portion of said rod for moving said rod up and down when said pivot axle and said follower are rotated by said shaft, said pivot axle being moved along said guiding member for adjusting the distance between said pivot axle and said shaft and for adjusting a moving stroke of said rod and said looper.

2. A looper driving assembly according to claim 1, wherein said coupling means includes a lever for pivotally coupling to the sewing machine at a pivot pin, said lever includes an extension pivotally coupled to said lower portion of said rod for moving said rod and said looper up and down when said lever is rotated about said pivot pin.

3. A looper driving assembly according to claim 2, wherein said coupling means further includes a link having a first end pivotally coupled to said pivot axle and having a second end pivotally coupled to said lever for rotating said lever when said follower is rotated by said shaft.

4. A looper driving assembly according to claim 1, wherein said guiding member includes a post, and a block slidably engaged on said post for sliding up and down along said post, said pivot axle is provided in said block.

5. A looper driving assembly according to claim 4, wherein said post includes a bottom portion for aligning with said shaft and for allowing said pivot axle to be moved to coincide with said shaft and for stopping said rod and said looper.

* * * * *